US008777058B2

(12) United States Patent
Haefele et al.

(10) Patent No.: US 8,777,058 B2
(45) Date of Patent: Jul. 15, 2014

(54) SPOUT ASSEMBLY FOR A REPLACEABLE FLUID RESERVOIR USED IN PERSONAL CARE APPLIANCES

(75) Inventors: Peter Haefele, Unterbergen (AT); Christian Mikula, Wernberg (AT)

(73) Assignee: Koninklijkle Philips N.V., Eindhoven (NL)

( * ) Notice: Subject to any disclaimer, the term of this patent is extended or adjusted under 35 U.S.C. 154(b) by 1898 days.

(21) Appl. No.: 11/629,824

(22) PCT Filed: Jun. 15, 2005

(86) PCT No.: PCT/IB2005/051978
§ 371 (c)(1),
(2), (4) Date: Jul. 10, 2008

(87) PCT Pub. No.: WO2005/123534

PCT Pub. Date: Dec. 29, 2005

(65) Prior Publication Data

US 2009/0162133 A1 Jun. 25, 2009

Related U.S. Application Data

(60) Provisional application No. 60/580,656, filed on Jun. 17, 2004.

(51) Int. Cl.
*B65D 35/54* (2006.01)

(52) U.S. Cl.
USPC ..... 222/96; 222/105; 222/207; 222/633; 401/270; 251/149.9

(58) Field of Classification Search
USPC ..... 222/105, 180, 181.3, 95–96, 207, 209, 222/633; 401/270; 251/149–149.3, 149.9; 215/250; 220/276; 15/22.2
See application file for complete search history.

(56) References Cited

U.S. PATENT DOCUMENTS

| | | | | |
|---|---|---|---|---|
| 1,253,309 | A * | 1/1918 | Ulleland | 285/8 |
| 2,841,806 | A * | 7/1958 | Blasi | 15/24 |
| 3,198,389 | A * | 8/1965 | Dunning | 222/93 |
| 3,608,782 | A * | 9/1971 | Sathicq | 222/94 |
| 4,375,864 | A | 3/1983 | Savage et al. | |
| 5,365,038 | A * | 11/1994 | Mitsugu | 219/386 |
| 5,839,715 | A * | 11/1998 | Leinsing | 251/149.1 |
| 5,993,180 | A * | 11/1999 | Westerhof et al. | 417/571 |
| 6,039,301 | A | 3/2000 | Westerhof et al. | |
| 6,142,341 | A * | 11/2000 | Uematsu | 222/92 |
| 6,394,316 | B1 * | 5/2002 | Daansen | 222/207 |
| 6,493,940 | B2 * | 12/2002 | Westerhof et al. | 30/41 |
| 6,691,893 | B2 * | 2/2004 | Gauthier | 222/95 |
| 6,789,706 | B2 * | 9/2004 | Abergel et al. | 222/207 |
| D502,601 | S * | 3/2005 | Lamason et al. | D4/101 |
| 2002/0032964 | A1 * | 3/2002 | Westerhof et al. | 30/41 |
| 2002/0113093 | A1 * | 8/2002 | De Laforcade | 222/321.9 |
| 2003/0221270 | A1 * | 12/2003 | Kuo | 15/29 |

FOREIGN PATENT DOCUMENTS

WO WO 2005/000541 1/2005

* cited by examiner

*Primary Examiner* — Paul R Durand
*Assistant Examiner* — Andrew P Bainbridge

(57) ABSTRACT

A pouch has an upper spout portion which is heat sealed to the opening of the pouch. The upper spout portion has two curved gripping elements and a receiving assembly that projects inside the pouch. The receiving assembly is configured to connect with a bellows pump that seats into the upper spout portion and can be removed by pinching the two curved gripping elements together. This action in turn allows a user to remove the bellows pump easily as desired.

10 Claims, 4 Drawing Sheets

SPOUT ASSEMBLY FOR A REPLACEABLE FLUID RESERVOIR USED IN PERSONAL CARE APPLIANCES

CROSS REFERENCE TO RELATED APPLICATION

This application claims the benefit of U.S. provisional application Ser. No. 60/580,656 filed 17 Jun. 2004, which is incorporated herein by reference.

This invention relates generally to fluid reservoir structures used in personal care appliances, such as a toothbrush, and more specifically concerns a spout assembly portion of the reservoir, with grip elements, for removing/installing the reservoir in the appliance.

Replaceable fluid-containing reservoirs, also referred to as cartridges, but generally referred to hereinafter as fluid reservoirs, for personal care appliances are well known. Examples of personal care appliances using replaceable fluid reservoirs include shavers and toothbrushes. In toothbrushes, the fluid is typically a dentifrice or oral medication. The fluid in the reservoir is moved from the reservoir to the workpiece, such as a brushhead, typically by a small pump. Such pumps are well known. Used reservoirs (empty) must be removed from a pump connecting line which extends into the reservoir and then replaced with a new, filled reservoir. An example of such a reservoir is shown in U.S. Patent Application Ser. No. 60/482,914, which is owned by the assignee of the present invention, the contents of which are hereby incorporated by reference.

Typically, such reservoirs will have a structure for connecting the reservoir to the pump in a fluid-tight relationship and a reservoir pouch for containing the fluid. Often, the connecting structure is made from a hard plastic, with the reservoir pouch being made from a thin, flexible plastic/metal material. Frequently, however, such existing reservoir structures, with existing connecting structures, are difficult to remove and replace, sometimes even painful, due to sharp edges and non-ergonomic design. It is often difficult to grasp the cartridges with sufficient force to overcome the attach/detach forces, especially with wet, slippery fingers.

Hence, it is desirable to provide a spout assembly for replaceable fluid reservoirs which is convenient and easy to use.

Accordingly, the present invention includes a spout assembly for a fluid reservoir used in a personal care appliance such as a power toothbrush, the spout assembly comprising: a spout portion with gripping elements at opposing sides thereof, the gripping elements having an outer surface portion which curves in a vertical plane, from top to bottom thereof; and a connecting structure which extends from the spout portion into a pouch portion of the fluid reservoir, for receiving a fluid receiving member portion of a fluid pump.

Figure 1:
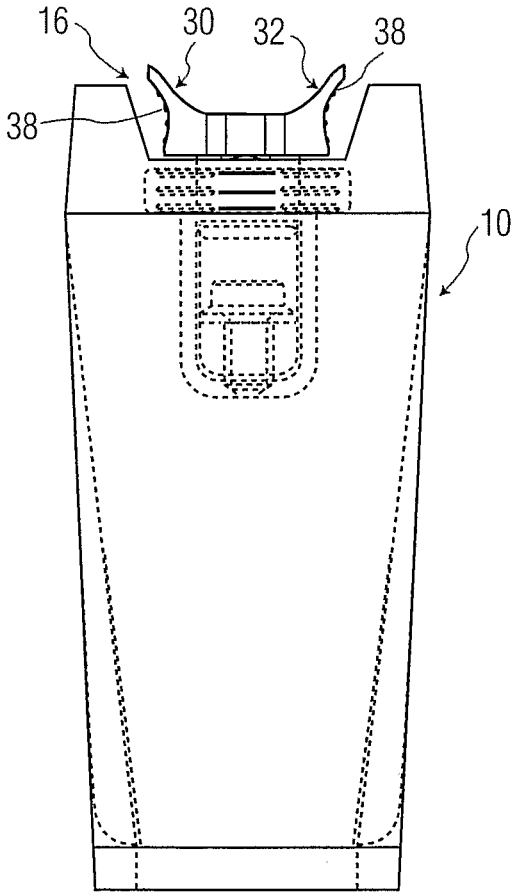
FIG. 1 is a perspective view showing a replaceable fluid reservoir with a spout assembly of the present embodiment.
Figure 2:
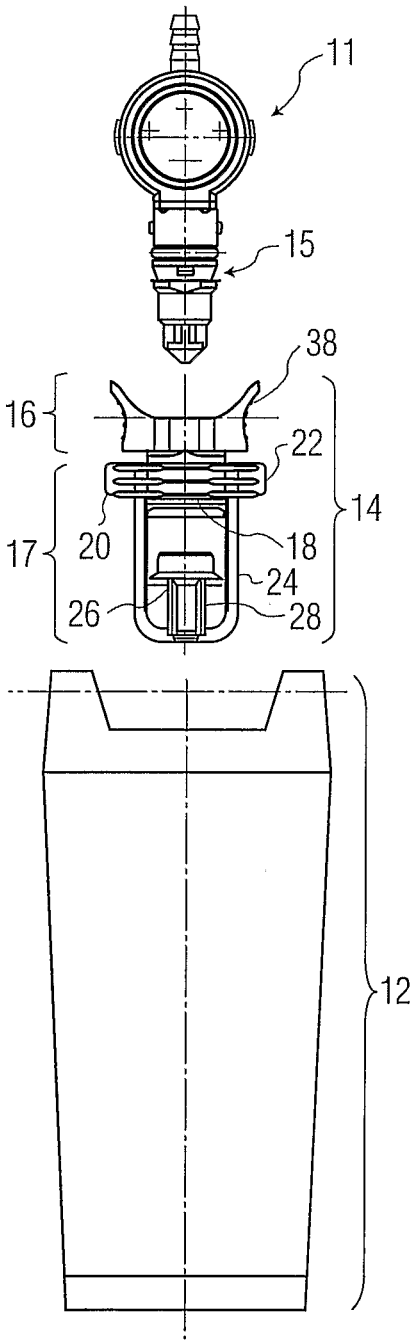
FIG. 2 is an exploded view of FIG. 1, shown with a pump for the fluid.

FIGS. 1 and 2 show a fluid reservoir or cartridge 10, which is used in fluid-dispensing personal care appliances, such as for example shavers and toothbrushes. In typical operation, fluid is moved from the reservoir 10 by means of a small pump

11 within the personal care appliance to the workpiece (not shown), which would be a brushhead in the case of a toothbrush.

Reservoir 10 comprises a flexible, fluid-containing pouch 12 and a spout assembly 14. The spout assembly 14 is sealed to pouch 12 in a fluid-tight arrangement. The spout assembly 14 is designed and configured to connect with a connecting tube assembly portion 15 of fluid pump 11, again in a fluid-tight relationship. In the embodiment shown, spout assembly 14 is made from a hard plastic, while pouch 12 is typically made from a thin, flexible plastic or metal material.

The spout assembly 14 includes an upper spout portion 16 and a receiving assembly 17 which extends from the upper spout portion 16 down into the pouch 12 and is adapted and configured to receive and position the connecting tube assembly 15 of the pump 11. This receiving assembly 17 can have various configurations. In the embodiment shown, it includes a short cylindrical portion 18 through which the connecting tube assembly 15 extends. In the embodiment shown, this cylindrical section has an outer diameter which varies between 10.5-11.5 mm and an inner diameter which varies between 8.5-9.7 mm over the length of the section and is approximately 14 mm long.

Extending outwardly from the cylindrical section 18 are two opposing wing elements 20, 22. Extending downwardly from wing elements 20 and 22 is a U-shaped member 24. At the bottom of U-shaped member 24 are opposed holding elements 26 and 28 which are configured and arranged relative to each other to hold a receiving plug 29 which closes the reservoir until it is to be used. When the plug is in its open position, it holds the end section 19 of the connecting tube assembly. In this position, fluid may be drawn out of the pouch 12. Receiving assembly 17 is positioned within pouch 12 when the reservoir is operatively connected to the pump.

Figure 3:
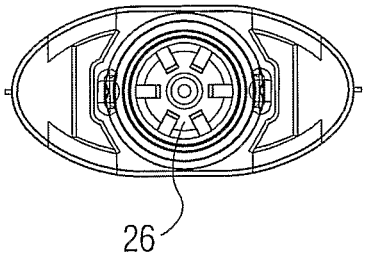
FIG. 3 is a top view of the spout structure.
Figure 4:
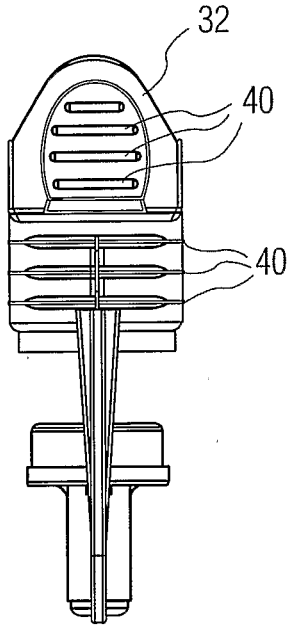
FIG. 4 is a side elevational view of the spout structure.
Figure 5:
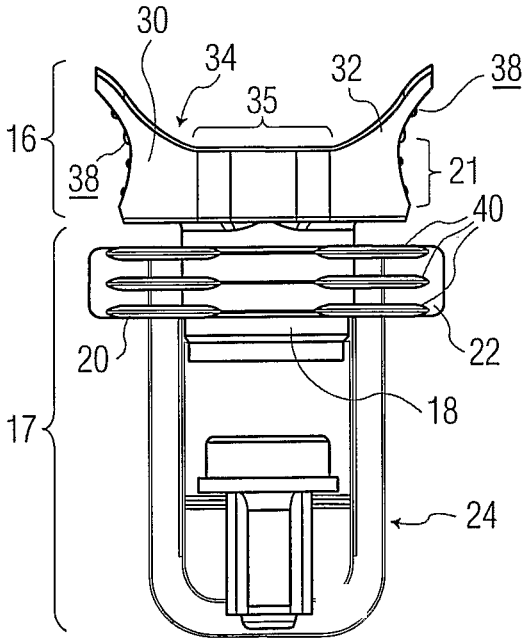
FIG. 5 is a front elevational view of the spout structure.
Figure 6:
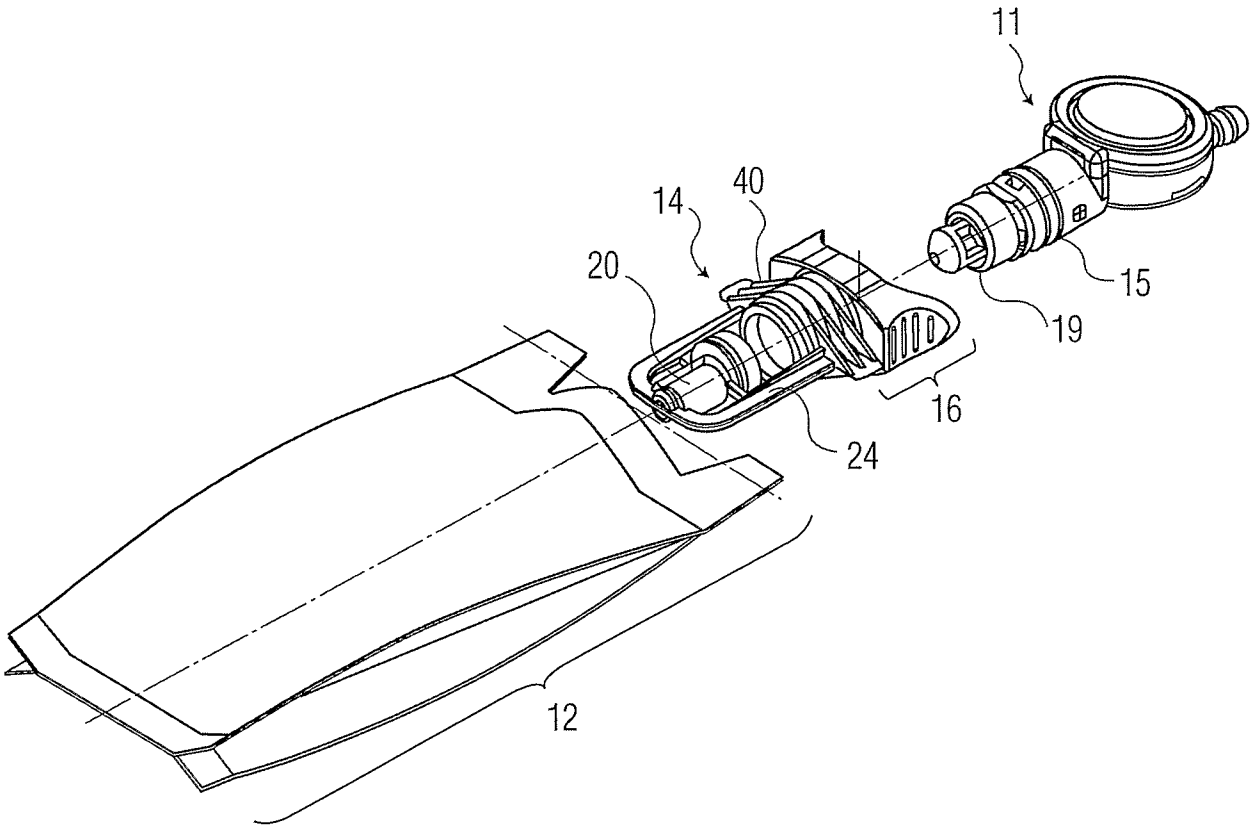
FIG. 6 is an exploded perspective view of the replaceable fluid reservoir of FIG. 1.

In the embodiment shown, upper spout portion 16 has a base 21 in the form of an ellipse with blunted ends. In the embodiment shown, the ellipse is approximately 23 mm long and 11.5 mm wide. In the center of upper spout portion 16 is a circular opening 26, (FIG. 3). Opening 26 allows passage of the connecting tube assembly 15 of the pump into pouch 12. In the embodiment shown, base section 21 is approximately 5 mm thick.

The upper spout portion includes two vertically extending wing sections 30, 32 at opposite ends of the base 21. Upper spout portion 16 has an upper edge 34 with a central flat portion 35 approximately 10 mm long. Upper edge 34 angles outwardly from the ends of the central portion 35 at approximately 45°, for approximately 8 mm, to the top of the wing sections 30 and 32. The thickness of the wing sections at this point (the top) is approximately 1.5 mm. Outer surface 38 of the wing sections 30, 32 curves downwardly and inwardly and then slightly outwardly again to the lower surface of the base 21, conforming to the fingertips of a user. The outer surface 38 of the wing sections includes a number of horizontal ridges 40, to provide a better finger grip for the user. Since the upper portion of the wing section sections is relatively thin, the wings are less stiff and flex slightly inwardly upon application of force against them.

In use, a user places a thumb and forefinger against the wing sections and then gently squeezes slightly inwardly, while at the same time pulling the reservoir off of the connecting tube assembly of the pump. A new, filled reservoir is then positioned onto the connecting tube assembly of the pump and pushed upwardly to connect therewith in a fluid-tight relationship. The personal care appliance is then ready to be used again.

Although a preferred embodiment of the invention has been disclosed for purposes of illustration, it should be understood that various changes, modifications and substitutions may be incorporated in the embodiment without departing from the spirit of the invention which is defined by the claims which follow. For instance, the fluid reservoir with the spout assembly may be used externally to a personal care appliance, such as a toothbrush. It could be mounted on a wall, for instance, or used in combination with other fluid dispensing systems to dispense fluid for an appliance, including a toothbrush.

The invention claimed is:

1. A spout assembly sealable to a fluid reservoir used in a personal care appliance, comprising:

an upper spout portion having an opening therethrough with gripping elements at opposing sides thereof, the gripping elements having an outer surface portion which curves in a vertical plane; and a receiving assembly portion integral with the upper spout portion which extends down from the upper spout portion into a pouch portion of the fluid reservoir for receiving a fluid connecting member portion of an external fluid pump, wherein the connecting member of the fluid pump is separable from the spout assembly and the fluid reservoir.

2. The spout assembly of claim 1, wherein the assembly extends for less than the full width of the pouch portion of the reservoir.

3. The spout assembly of claim 1, including a plurality of small ridges positioned on the curved outer surface portion of the gripping elements.

4. The spout assembly of claim 1, wherein the upper spout portion includes a base part, with the gripping elements located at the opposing ends of the base part and extending above the base part.

5. The spout assembly of claim 4, wherein the base part has a circumference in the general shape of an ellipse.

6. The spout assembly of claim 4, wherein the fluid reservoir is adapted for a power toothbrush.

7. A fluid reservoir assembly for use with a personal care appliance, comprising:

a pouch member containing fluid for use in a personal care appliance;

a spout assembly to which the pouch member is connected in a fluid-tight relationship, the spout assembly having an upper portion with an opening therethrough for receiving a fluid connecting member from a fluid pump for movement of the fluid from the reservoir, the upper spout portion having gripping elements on opposing sides thereof, each gripping element having an outer surface portion which is curved from top to bottom, to accommodate the fingers of a user, the spout assembly further including an integral receiving assembly which extends down into the pouch and receives and positions the fluid connecting member in a fluid-tight relationship therewith, wherein the receiving assembly and the reservoir are is separable from the connecting member of the fluid pump.

8. The fluid reservoir of claim 7, wherein the fluid reservoir is adapted for use in a power toothbrush.

9. The fluid reservoir of claim 7, wherein the fluid reservoir is adapted for use as a tooth paste dispenser external to a power toothbrush.

10. The fluid reservoir of claim 9, wherein the fluid reservoir is mountable on a wall for dispensing tooth paste therefrom into a brushhead portion of a toothbrush.

* * * * *